US005615485A

United States Patent [19]

Stoneberg

[11] Patent Number: 5,615,485

[45] Date of Patent: Apr. 1, 1997

[54] INSTRUMENTS FOR DRAWING CIRCLES

[75] Inventor: Bruce Stoneberg, LaGrange, Ill.

[73] Assignee: Safe-T Products, Inc., Franklin Park, Ill.

[21] Appl. No.: 399,439

[22] Filed: Mar. 7, 1995

[51] Int. Cl.[6] ..... B43B 9/04

[52] U.S. Cl. ..... 33/27.03; 33/27.01; 33/489; 33/562

[58] Field of Search ..... 33/27.01, 27.02, 33/27.03, 27.04, 27.07, 489, 562, 563, 565, 566, 678, 666

[56] References Cited

U.S. PATENT DOCUMENTS

| | | | |
|---|---|---|---|
| 2,958,132 | 11/1960 | Hartbauer et al. | 33/27.03 |
| 4,129,948 | 12/1978 | Hatter et al. . | |
| 4,171,574 | 10/1979 | Gratzl et al. . | |
| 4,267,638 | 4/1981 | Heinz | 33/27.03 |
| 4,353,166 | 10/1982 | Kettlestrings . | |
| 4,542,588 | 9/1985 | Werner . | |
| 5,050,309 | 9/1991 | Wang | 33/27.03 |
| 5,384,964 | 1/1995 | McKay | 33/27.03 |
| 5,426,859 | 6/1995 | Concari et al. | 33/27.03 |

FOREIGN PATENT DOCUMENTS

| | | | |
|---|---|---|---|
| 56864 | 4/1911 | Switzerland | 33/27.03 |

*Primary Examiner*—Christopher W. Fulton
*Attorney, Agent, or Firm*—Laff, Whitesel, Conte & Saret, Ltd.

[57] ABSTRACT

A device for forming circles on a drawing surface that includes, in part, a first rotatable member and a second rotatable member. The first rotatable member is substantially flat and includes an opening formed therein. The second rotatable member is resiliently disposed within the opening. A first means elevates the first rotatable member above the drawing surface to prevent smearing of lines on the surface. A second means elevates the second rotatable member above the drawing surface to prevent smearing of lines on the surface and to engage the surface for stabilizing the rotatable member over the surface. The second mechanism elevates the second rotatable member to approximately the same level as the first rotatable member. A plurality of holes are disposed in the first and second rotatable members. The holes accommodate a marking instrument used for forming the circles.

12 Claims, 2 Drawing Sheets

INSTRUMENTS FOR DRAWING CIRCLES

FIELD OF THE INVENTION

This invention relates to devices for forming circles. More particularly, this invention relates to devices for forming circles on hard surfaces such as the mylar and glass surfaces encountered in the use of overhead projectors.

BACKGROUND OF THE INVENTION

There are numerous devices for forming circles in the prior art. Some of these devices require sharp pivot points to which pivot arms are connected with marking means for inscribing the circles. However, these devices are unsuitable for use on hard surfaces, such as, for example, on the glass or mylar surfaces encountered in the use of overhead projectors. This is because the sharp pivot points deface the surface upon which the circle is being inscribed by leaving small holes in the Mylar surface or permanently scratching the glass surface. In addition, the sharp points of these devices render them unsafe.

Consequently, devices for forming circles without sharp points have been designed in an effort to circumvent the problems associated with such prior art devices. One such device is disclosed in U.S. Pat. No. 4,353,166 and comprises a flat member with a circular hole adjacent one end. A rotatable disk is releasably retained within the hole. A series of small holes sized to receive a marking instrument are spaced from the center point of the disk to the far end of the flat member at specific intervals. In use, the disk is held in the desired location and large circles are formed by holding the flat member in the desired location, inserting the marking instrument into the desired hole and rotating the flat member around the disk. Small circles are formed by inserting the marking instrument into the desired hole in the disk and rotating the disk within the flat member.

Another device for forming circles is disclosed in U.S. Pat. No. 4,530,156 which comprises a flat member with a first rotatable disk having a series of holes spaced at intervals and sized to receive a marking instrument. A second rotatable disk is disposed within the first rotatable disk and has at least one hole for receiving a marking instrument. The rotational position of the second disk may be changed relative to the first disk for adjusting the spacing of the hole in the second disk from a center point on the first disk.

While the above devices provide a means for forming circles on mylar, glass, and other delicate surfaces, there are problems associated with their use. For example, these devices frequently slide on the surface during circle formation. This sliding movement results in assymetrically formed circles. Moreover, since such surfaces often are non-absorbent (unlike e.g. paper) smearing of the still-wet lines on the drawing surface often occurs as the flat members and/or rotatable disks rub against the drawing surface during rotation. Such smearing is especially prevalent with the wet ink of felt or nylon tipped pens used on drawing surfaces displayed using overhead projectors.

Accordingly, an object of the present invention is to provide a device for forming circles that firmly engages the drawing surface to stabilize the device over the surface during circle construction.

It is another object of the present invention to provide a device for forming circles that prevents smearing of the still-wet lines on the drawing surface during formation of the circles.

It is yet another object of the present invention to provide a device for forming circles that facilitates locating the device over the center point of a circle and/or marking the center point of a circle with a marking instrument.

It is a further object of the present invention to provide a device for forming circles that is relatively inexpensive.

SUMMARY OF THE INVENTION

The present invention accomplishes the foregoing objects by providing a device for forming circles on a drawing surface that includes a first rotatable member and a second rotatable member. The first rotatable member is substantially flat and includes an opening formed therein. The second rotatable member is resiliently disposed within the opening. Elevation means space the first rotatable member above the drawing surface to prevent smearing of still-wet lines on the surface. Combination means elevate the second rotatable member above the drawing surface also to prevent smearing of still-wet lines on the surface and also firmly engage the drawing surface to stabilize the second rotatable member over the surface. The combination means preferably elevate the second rotatable member to approximately the same level as the first rotatable member. A plurality of holes are disposed over the rotatable members and accommodate marking instruments used for forming the circles.

The opening in the first rotatable member is generally circular and comprises alternating upper and lower lips disposed along its circumference. The second rotatable member is a generally circular disc which comprises a circumferentially extending flange that releasably engages the lips for rotatably retaining the disc within the hole. The holes in the rotatable members are spaced at calibrated intervals to accommodate different circle radii.

In a preferred embodiment, the elevation means comprise at least one dimple disposed on the bottom of the first rotatable member. Likewise, the combination means comprise an eyelet with an upper smooth surface and a lower rough surface on the second rotatable member. The rough surface of the eyelet includes a plurality of splayed teeth (preferably projecting so that their leading edges are not coplanar) for elevating the second rotatable member above the drawing surface and for engaging the drawing surface to stabilize the rotatable member. Alternatively, a series of similar uneven projections or other rough surface could be molded into or onto the member to form the lower rough surface. The eyelet in the preferred embodiment further includes an aperture for locating the second rotatable member over the center point of a circle and/or marking the center point of the circle with a marking instrument. The combination means are centrally located on the second rotatable member.

In use, the first rotatable member (with marking instrument engaged) is rotated about the second rotatable member to form circles having a radius larger than the radius of the second rotatable member. The rough surface of the eyelet of the second rotatable member engages the drawing surface as the first rotatable member is being rotated so that the second rotatable member remains stationary over the drawing surface to form a symmetrical circle. In addition, the dimples elevate the first rotatable member above the drawing surface to avoid smearing of still-wet lines on the drawing surface.

Likewise, the second rotatable member (with marking instrument) is rotated within the first rotatable member to form a circle with a radius less than the radius of the second rotatable member. In addition, a marking instrument may be inserted into one of a plurality of large template holes in the second rotatable member for forming circles having diameters smaller than the smallest diameters of the circles formed with the second rotatable member. In each instance, the eyelet spaces the second rotatable member above the drawing surface to prevent smearing of still-wet lines on the surface.

In an alternate embodiment, there are no dimples disposed along the bottom of the first rotatable member (not shown). However, the second rotatable member includes an eyelet.

The above, as well as other objects and advantages of the invention, will become apparent from the following detailed description of the preferred embodiment, reference being made to the accompanying drawings.

DETAILED DESCRIPTION OF THE INVENTION

Figure 1:
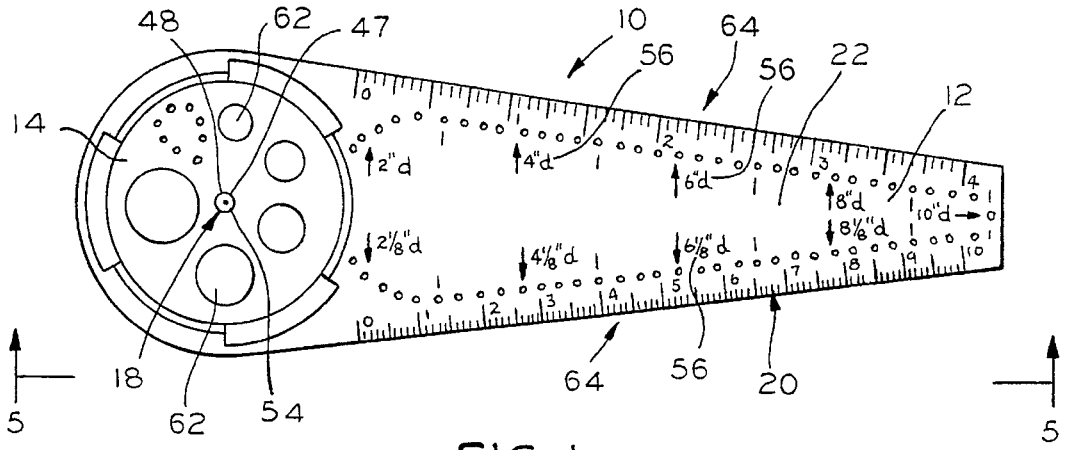
FIG. 1 is a top plan view of the inventive device for forming circles.

Generally referring to FIGS. 1–6, the invention constitutes a device for forming circles on a drawing surface, denoted by the numeral 10, comprising, in part, a first rotatable member 12 and a second rotatable member 14. A first means 16 elevates the first rotatable member above the drawing surface to prevent smearing of still-wet lines on the surface. A second means 18 elevates the second rotatable member above the drawing surface to prevents smearing of still-wet lines on the surface, and engages the drawing surface for stabilizing the rotatable member over the surface. A plurality of holes 20 are disposed in the first and second rotatable members and are adapted to accommodate a marking instrument for forming the circles.

As shown in FIGS. 1–5, first rotatable member 12 is substantially flat and includes a top 22 and a bottom 24. A generally circular opening 26 with a circumferential wall 28 is formed at one end of first rotatable member 12. Alternating upper lips 30 and lower lips 32 project radially inward from circumferential wall 28 of opening 26. Second rotatable member 14 is a generally circular disc and includes a top 34 and a bottom 36 which are coplanar with top 22 and bottom 24, respectively, of first rotatable member 12. Second rotatable member 14 includes a circumferentially extending flange 38 which resiliently engages alternating lips 30, 32 of opening 26 for rotatably retaining the disc within the hole.

Figure 2:
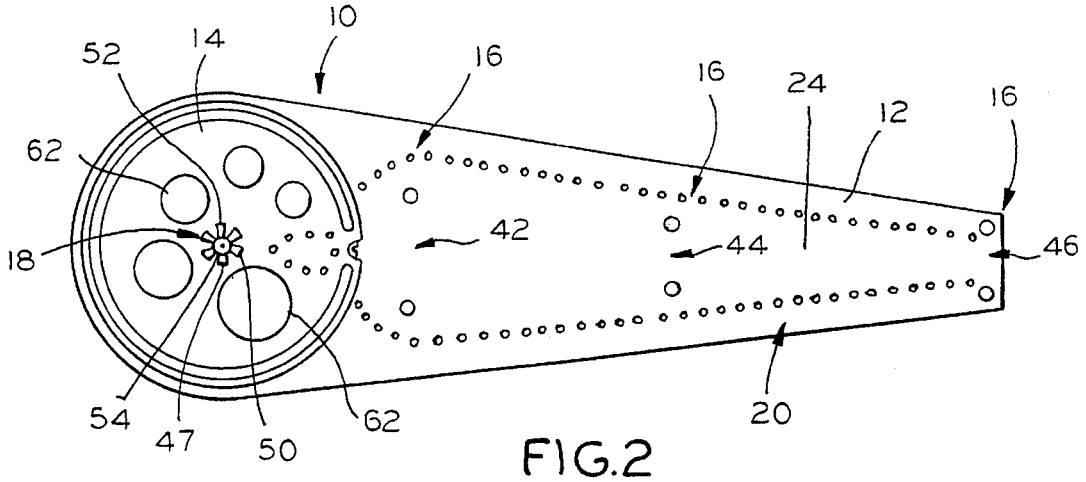
FIG. 2 is a bottom plan view of the circle-forming device of FIG. 1.
Figure 5:
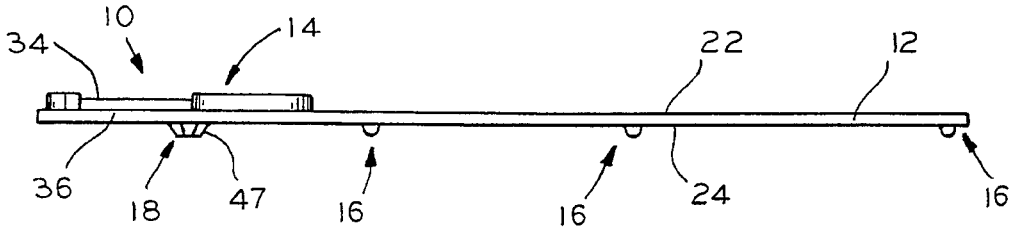
FIG. 5 is a side view of the circle-forming device, taken along lines 5—5 of FIG. 1.
Figure 6:
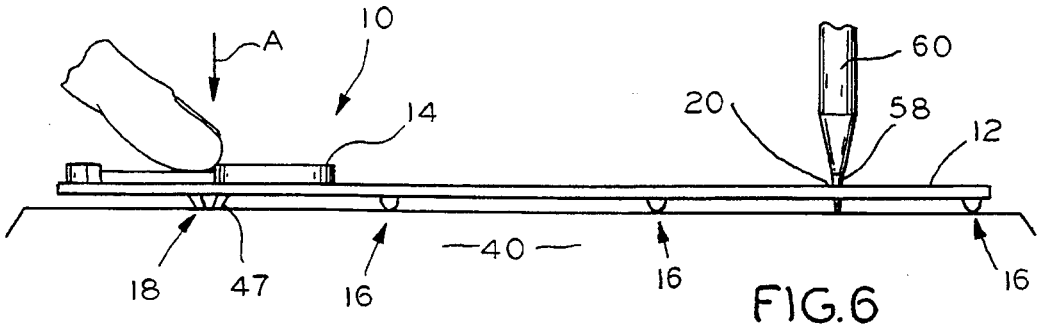
FIG. 6 is another side view of the circle-forming device of FIG. 5, illustrating its elevated appearance above the drawing surface during circle construction.
Figure 3:
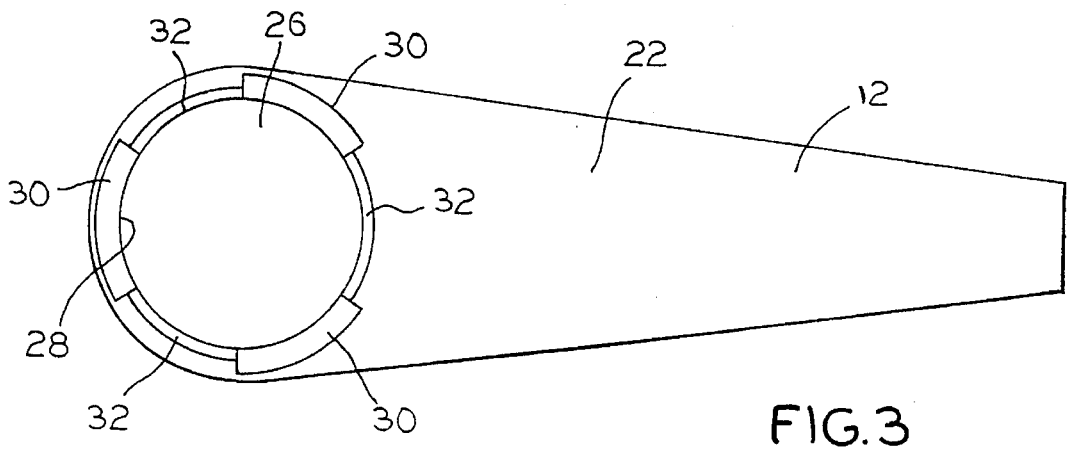
FIG. 3 is a top plan view of the first rotatable member of FIG. 1.
Figure 4:
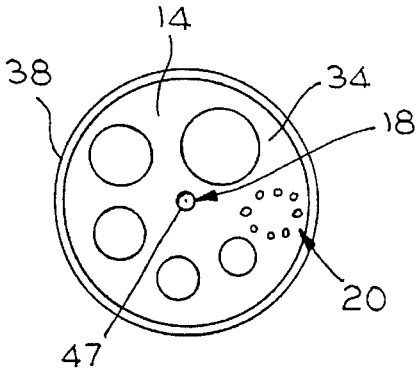
FIG. 4 is a top plan view of the second rotatable member of FIG. 1.

Elevation means 16 are disposed on bottom 24 of first rotatable member 12 and include at least one dimple (FIGS. 2, 5). Elevation means 16 space first rotatable member 12 above drawing surface 40 to prevent smearing of still-wet lines on the surface (FIGS. 5, 6). In the preferred embodiment, there are at least three pairs of dimples 42, 44, 46 disposed on bottom 24 of first rotatable member 12. Dimple pairs 42, 44, 46 are spaced from one another and generally located on the distal end of first rotatable member 12, adjacent second rotatable member 14, and generally mid-center of the distal end and the second rotatable member (FIG. 2).

Combination means 18 is centrally located on second rotatable member 14 and comprises a hard metallic eyelet 47 (FIGS. 1, 2). Combination means 18 elevates second rotatable member 14 above drawing surface 40 to prevent smearing of still-wet lines on the surface and engages the drawing surface to stabilize second rotatable member 14 over the surface (FIG. 6). Combination means 18 comprises a substantially smooth surface 48 on top 34 of second rotatable member 14 and a rough surface 50 on bottom 36 of the member. Rough surface 50 of combination means 18 comprises a plurality of splayed teeth 52 which engage the surface to stabilize second rotatable member 14 (FIG. 2). Preferably, the teeth will be unevenly splayed to present a rougher, non-coplanar series of teeth edges. Combination means 18 also comprises an aperture 54 for locating second rotatable member 14 over the center point of the circle and/or marking the center point with a marking instrument.

Combination means 18 elevate second rotatable member 14 to approximately the same level as first rotatable member 12 (FIGS. 5, 6).

Holes 20 in first rotatable member 12 and second rotatable member 14 are spaced at calibrated intervals and include indicia markings 56 adjacent the holes for selecting a predefined radius for drawing a circle (FIG. 1). A tip portion 58 of a marking instrument 60 is inserted into one of holes 20 to form circles with varying diameters (FIG. 6). For example, tip portion 58 may be inserted into one of holes 20 in first rotatable member 12 for forming larger circles with diameters from, for example, 1 ¾ inch to 10 inches. Likewise, tip portion 58 may be inserted into one of holes 20 in second rotatable member 14 for forming smaller circles with diameters from, for example, ⅝ inch to 1 ⅝ inch. In addition, tip portion 58 may be inserted into one of a plurality of large template holes 62 in second rotatable member 14 for forming even smaller circles with diameters from, for example, ¼ inch to ½ inch (FIGS. 1 and 2).

Figure 7:
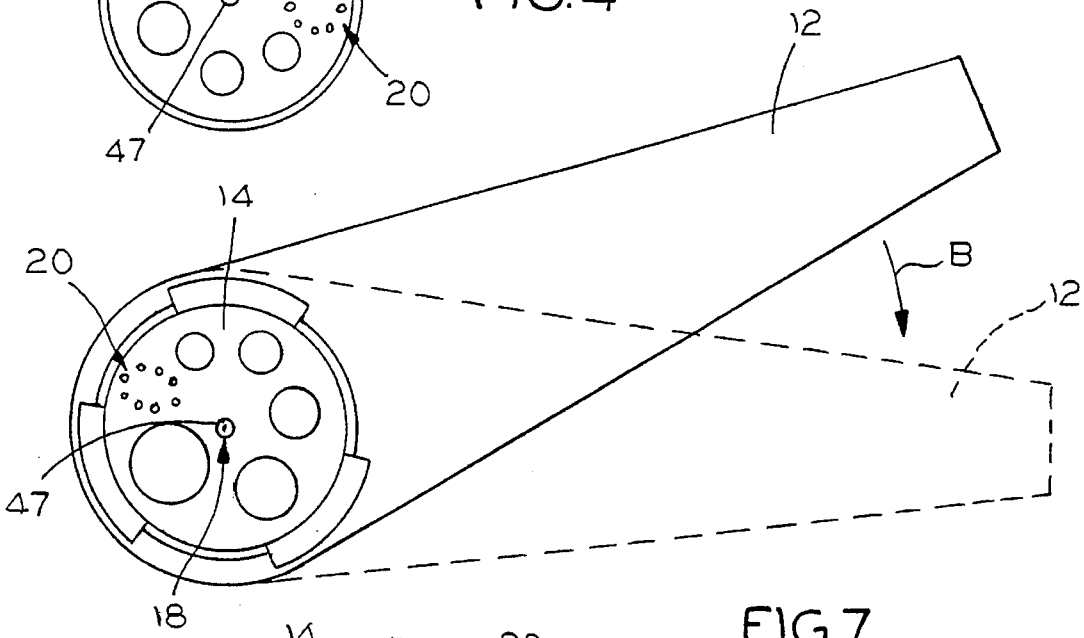
FIG. 7 is a top plan view of the circle-forming device of FIG. 1, illustrating the rotation of the first rotatable member.

In use, second rotatable member 14 is positioned within opening 26 of first rotatable member 12 and device 10 is placed on the drawing surface. A circle having a radius greater than the radius of second rotatable member 14 (or, for example, a diameter from 1 ¾ inch to 10 inches) is drawn by approximating the center point of the unformed circle and positioning eyelet 47 of second rotatable member 14 over the point. The center point of the circle may be marked by passing tip portion 58 of marking instrument 60 through aperture 54 of eyelet 47. Tip portion 58 of marking instrument 60 is then inserted into the appropriately marked hole on first rotatable member 12 as second rotatable member 14 and eyelet 47 are firmly held against the drawing surface (as indicated by arrow A in FIG. 6). As first rotatable member 12 is rotated about second rotatable member 14 (as indicated by arrow B in FIG. 7), tip portion 58 marks the drawing surface below the first rotatable member until a circle has been inscribed on the surface. During this process, eyelet 47 engages the surface as first rotatable member 12 is being rotated so that second rotatable member 14 remains stationary over the drawing surface to form a symmetrical circle. In addition, dimple pairs 42, 44, 46 elevate first rotatable member 12 above the drawing surface to avoid smearing of still-wet lines on the drawing surface.

Figure 8:
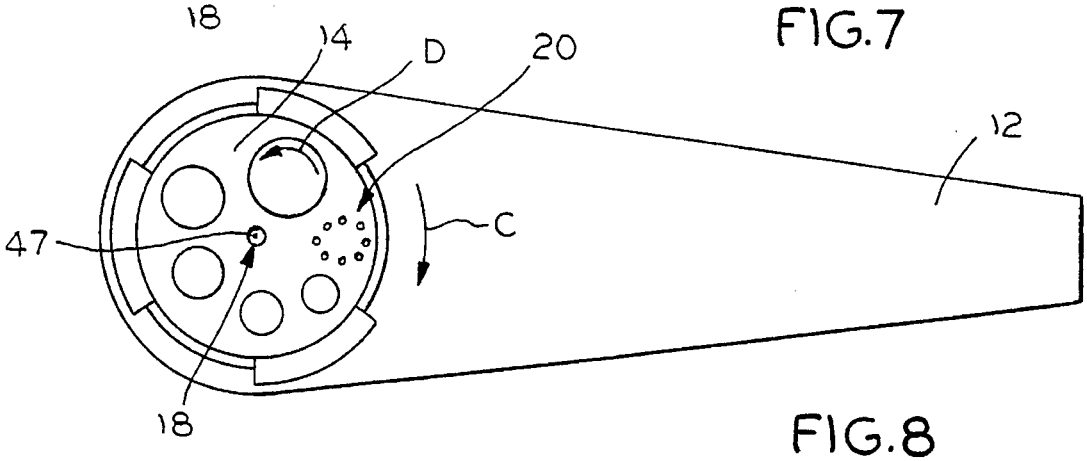
FIG. 8 is a top plan view of the circle-forming device of FIG. 1, illustrating the rotation of the second rotatable member.

A circle having a radius less than the radius of second rotatable member 14 (or, for example, a diameter from ⅝ inch to 1 ⅝ inch) is drawn by approximating the center point of the unformed circle and again positioning eyelet 47 over the point. Tip portion 58 is inserted into the appropriately marked hole in the second rotatable member as first rotatable member 12 is firmly held against the drawing surface. Second rotatable member 14 is then rotated within opening 26 of the first rotatable member (as indicated by arrow C in FIG. 8) until a circle has been formed on the drawing surface. In addition, a circle having a radius which is less than the smallest radius formed by rotating the second rotatable member (or a diameter from ¼ inch to ½ inch) may be drawn by inserting tip portion 58 into one of template holes 62 in second rotatable member 14 and moving the marking instrument along the inner circumferential wall of the template hole, as indicated by arrow D in FIG. 8. In each instance, eyelet 47 elevates second rotatable member 14 above the drawing surface to prevent smearing of still-wet lines on the surface.

Additional indicia 64 may be located along the linear edges of first rotatable member 12 (FIG. 1). For example, such indicia may include an inch and metric scale which may be used for making measurements.

While device 10 is primarily-adapted for use with the mylar or glass drawing surface of an overhead projector, it also has application on other hard or non-absorbent surfaces including, but not limited to, wood, metal, and plastic.

The material from which the first and second rotatable members of device 10 are constructed is preferably a transparent plastic material for viewing the circle beneath the device as it is being drawn. Eyelet 47 is preferably made of brass or any other suitable metal. Moreover, device 10 has not been described in terms of approximate measurements, as it should be understood that the dimensions of the device may vary according to need.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. A device for forming circles with a marking instrument on a drawing surface comprising:

a first rotatable member having an opening formed therein, said first rotatable member being substantially flat, said first rotatable member having a plurality of holes disposed therein, said holes accommodating the marking instrument used for forming the circles;

a second rotatable member resiliently disposed within and coplanar with said opening, said second rotatable member having a plurality of holes disposed therein, said holes accommodating the marking instrument used for forming the circles;

combination means for elevating said second rotatable member above the drawing surface to prevent smearing of lines on the surface and for engaging the drawing surface to stabilize said second rotatable member over the surface, said combination means including an aperture for locating said second rotatable means over a center point of a circle; and elevation means for spacing said first rotatable member above the drawing surface to prevent smearing of lines on the surface, said first rotatable member being elevated by said elevation means to approximately the same level as said second rotatable member.

2. The device of claim 1 wherein said first rotatable member includes a top and a bottom, and said elevation means are disposed on said bottom.

3. The device of claim 1 wherein said elevation means comprises at least one dimple.

4. The device of claim 1 wherein said second rotatable member includes a top and a bottom, and said combination means comprise an upper smooth surface on the top and a lower rough surface on the bottom.

5. The device of claim 4 wherein said rough portion comprises a plurality of sharp projections for engaging the drawing surface to stabilize said second rotatable member.

6. The device of claim 4 wherein said rough portion comprises a plurality of splayed metallic teeth for engaging the drawing surface to stabilize said second rotatable member.

7. The device of claim 6 in which the metallic teeth are unevenly splayed.

8. The device of claim 4 wherein said rough portion is molded into or onto said second rotatable member.

9. The device of claim 1 wherein said combination means is centrally located on said second rotatable member.

10. The device of claim 1 wherein said combination means comprises a metallic eyelet.

11. The device of claim 1 wherein said opening in said first rotatable member is generally circular and includes upper and lower lips disposed along its circumference, and said second rotatable member is a generally circular disc and includes a circumferentially extending flange, said flange resiliently engaging said alternating lips for rotatably retaining said disc within said hole.

12. The device of claim 1 wherein said holes in said first rotatable member and said second rotatable member are spaced at intervals.

* * * * *